United States Patent [19]

Tix

[11] Patent Number: 4,726,148

[45] Date of Patent: Feb. 23, 1988

[54] WINDOW WITH REMOVABLE JAMB LINER AND BRACKET FOR RELEASING SAME

[76] Inventor: Ronald E. Tix, 1178 W. 14th St., Hastings, Minn. 55033

[21] Appl. No.: 914,286

[22] Filed: Oct. 2, 1986

[51] Int. Cl.[4] ..... E05D 15/22; E06B 1/04

[52] U.S. Cl. ..... 49/453; 49/490; 52/213; 52/399

[58] Field of Search ..... 52/399, 208, 397, 398, 52/213, 211, 212, 718.1; 49/490, 491, 181, 453

[56] References Cited

U.S. PATENT DOCUMENTS

| | | | |
|---|---|---|---|
| 2,990,040 | 6/1971 | Stevenson | 52/212 |
| 3,442,059 | 5/1969 | Kessler | 52/399 |
| 3,606,433 | 9/1971 | Kunevicius | 52/718.1 X |
| 3,916,055 | 10/1975 | Wagner | 52/718.1 X |
| 4,092,813 | 6/1978 | Eggert | 52/397 |
| 4,144,674 | 3/1979 | Douman | 49/181 X |
| 4,170,090 | 10/1979 | Wood | 49/181 X |
| 4,364,199 | 12/1982 | Johnson et al. | 49/453 X |
| 4,407,100 | 10/1983 | Huelsekopf | 52/212 |

FOREIGN PATENT DOCUMENTS

| | | | |
|---|---|---|---|
| 848190 | 8/1970 | Canada | 52/399 |

*Primary Examiner*—Alfred C. Perham

*Attorney, Agent, or Firm*—Peterson, Wicks, Nemer & Kamrath

[57] ABSTRACT

A channel-shaped bracket of polyvinyl chloride having leg portions possessing a durometer value on the order of Shore D90 and hook portions integral with the free edges of the leg portions that have a durometer value on the order of Shore A70 is disclosed. The relatively soft and more flexible hook portions releasably engage ridge hooks extending in a recessed relation along the marginal edges of a jamb liner, the jamb liner also being of polyvinyl chloride with a durometer value on the order of Shore D90. The hook portions, being softer and more flexible than the ridge hooks as indicated above, readily release the jamb liner when a sufficient pull is applied so that the liner can be easily removed from the wooden jamb to which it is attached. The web of the bracket is sufficiently thin such that the bracket can be stapled to the wooden jamb.

14 Claims, 5 Drawing Figures

WINDOW WITH REMOVABLE JAMB LINER AND BRACKET FOR RELEASING SAME

BACKGROUND OF THE INVENTION

1. Field of the Invention

This invention relates generally to double-hung sash-type windows in which the sashes can be individually tilted and removed, and pertains more particularly to a bracket that will readily release the jamb liner after the sash has been taken out.

2. Description of the Prior Art

Double-hung windows with removable sashes are not new. Such windows are generally described, for instance, in U.S. Pat. No. 4,364,199, granted on Dec. 21, 1982 to William M. Johnson et al for "Removable-Tilt-Out Window Construction." While a relatively complex jamb liner is disclosed in this patent, plastic jamb liners of simpler constructions are rather widely used. The difficulty with the jamb liners with which I am acquainted is that they are attached to the side jambs of the window frame in such a manner that the jamb liner cannot be removed without damaging the jamb liner, frequently to such a degree that it cannot be reused. The problem stems from the use of metal brackets, usually of aluminum, that are nailed or screwed to the side jamb of the window frame, the prior art brackets having relative rigid and stiff hook portions thereon that engage the mating ridge hooks on the jamb liner, the rigidity being such that the jamb liner cannot be easily detached from such brackets. Therefore, a need has existed for a number of years for a bracket that will firmly hold the jamb liner in place, yet when circumstances so dictate permit the jamb liner to be removed without damaging either the bracket or the jamb liner.

SUMMARY OF THE INVENTION

Accordingly, an important object of the present invention is to provide a bracket that will, when necessary to do so, release the jamb liner that it is holding in place. More specifically, an aim of the invention is to provide a bracket of elastomeric material having a dual durometer value so that flexible hook portions thereon will yield or bend sufficiently to free the jamb liner when a sufficient amount of manual force is appropriately applied to the liner.

Another object is to provide a bracket capable of releasing the jamb liner, but which is rugged enough to permit repeated removal and replacement of the jamb liner without damage to either the jamb liner or the bracket, there usually being several brackets holding the jamb liner.

Yet another object of the invention is to provide a jamb liner of the foregoing character that can be detached from the several brackets holding it in place without the need of tools or other implements (although a conventional screwdriver may very well be used to initially pry a longitudinal section at the jamb liner away from the first bracket). In this regard, it is contemplated that the jamb liner, after the sash has been taken out, can be detached by merely grasping the jamb liner adjacent one edge thereof and working either upwardly or downwardly to free that edge, and then following the same procedure in effecting the release of the other edge.

A further object is to enable the jamb liner, after having been removed, to be replaced in the same fashion that it was initially installed. More specifically, the initial installation requires only that the jamb liner be snapped into engagement with the holding brackets, and the same technique is available when replacing the jamb liner.

Still another object is to provide a bracket capable of releasing a jamb liner in which the bracket is of plastic material that can be easily stapled to the side jamb of the window frame, whereas previously the stamped metal brackets had to be either nailed or screwed to the jamb through the agency of several mounting holes provided in each bracket. Thus, the manufacture of my release-type bracket is simpler than heretofore, and can actually be fabricated at a low cost, especially in that the bracket can be extruded in relatively long lengths and then cut to size.

A specific object of my invention is to provide a plastic bracket having flexible hook portions thereon that will flex sufficiently so that the jamb liner that it (and others) is holding can be removed. In this regard, an aim of the invention is to provide a bracket, such as polyvinyl chloride (PVC), which can be extruded or molded from material having two degrees of hardness, that is, two decidedly different durometer values.

Briefly, my invention envisages the employment of plastic brackets in contradistinction to metal brackets, the plastic brackets having flexible hook portions that releasably engage the ridge hooks extending along the marginal edges of an extruded plastic jamb liner. Jamb liners fabricated in accordance with my invention can be easily stapled to the wooden side jambs of the window frame. Once so attached all that the installer need do is to snap in place the plastic jamb liner. However, when it becomes necessary to remove the jamb liner, the workman need only grasp the jamb liner along one edge thereof and progressively dislodge that edge from the various brackets, more specifically, from the flexible hook portions thereof that are retaining that particular edge of the jamb liner in place. While no tool or other implement is required, the worker can, if he chooses to do so, utilize a screw driver for prying the first edge of the jamb liner from one of the hook portions on the first of several brackets retaining the jamb liner in place. Similarly, the opposite edge of the jamb liner can likewise be easily detached. The removal of the entire jamb liner can be achieved without damage to either the plastic jamb liner or any of the plastic brackets utilizing the teachings of my invention.

DESCRIPTION OF THE PREFERRED EMBODIMENT

Figure 1:
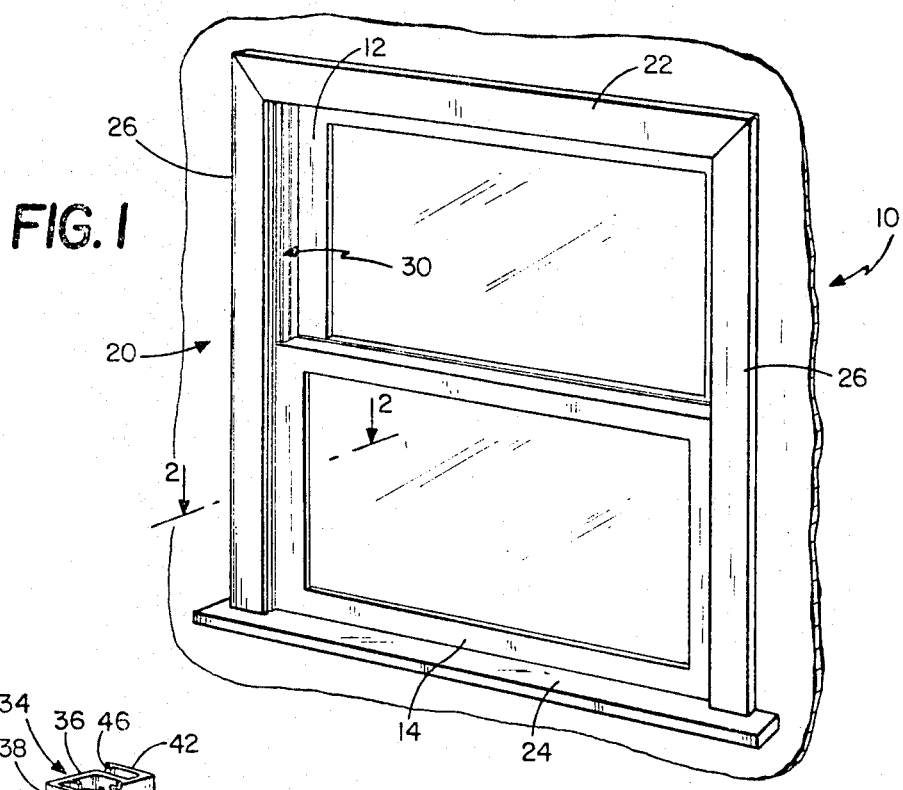
FIG. 1 is a perspective view of a typical double-hung sash-type window.
Figure 3:
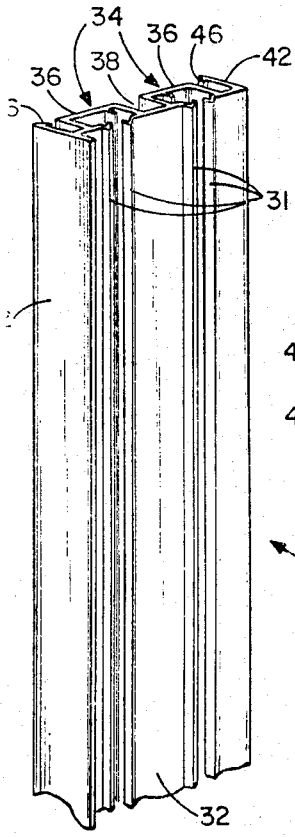
FIG. 3 is a perspective view of a conventional jamb liner.

Referring first to FIG. 1, a typical window unit 10 has been pictured. The window unit 10 includes a slidable upper sash 12 and a slidable lower sash 14, each of which can be tilted and removed for cleaning and/or replacement. From FIG. 2 it will be discerned that the lower sash 14, as does the upper sash, has a tracking groove 16. The window unit 10 also includes a wooden frame 20 having a header 22, a sill 24 and side jambs 26.

Mainly for weatherproofing reasons, a plastic jamb liner denoted generally by the reference numeral 30 is employed, there being one such jamb liner 30 at each side of the frame 20 for the two sashes 12 and 14, although only one is visible in FIG. 1. The jamb liner 30, in each instance, extends from the header 22 down to the sill 24. Jamb liners are customarily of extruded polyvinyl chloride, being usually quite hard in that the PVC has a Shore durometer value of D90 or so. The jamb liner 30 includes two pairs of angled rails 31, one pair extending into the groove 16 at that side of the sash 14. See FIG. 2. The other pair of rails 31 extend into the corresponding groove (not shown) in the sash 12. A connecting web portion 32 extends between flanking channel sections 34, each of which has a web portion 36. In this way, a longitudinal groove 38 is formed between the two channel sections 34. Additionally, the jamb liner 30 includes an outwardly issuing marginal strip 40 at each side thereof plus an outer wall 42, the outer wall 42 in each instance forming a groove 44 with respect to the side of the channel section 34 with which it is spacedly associated. Of importance in appreciating the present invention is the presence of inturned ridge hooks 46 that extend along each side of the jamb liner 30.

Attention is now directed to a channel-shaped bracket 50 exemplifying my invention which is comprised of a web 52, web extensions 54 residing in the same plane as the web 52, leg portions 56 and hook portions 58. From FIG. 2 it can be seen that the hook portions 58 engage the ridge hooks 46. However, the entire jamb liner 30, as already mentioned, is composed of relatively rigid plastic material, usually PVC possessing the 90 or so D scale value. Because of the rigidity possessed by the ridge hooks 46 of the jamb liner 30, the use of metal brackets having hook portions have presented a serious removal problem in that they will not release the jamb liner 30 without seriously damaging the metal brackets and usually the plastic jamb liner, too.

Accordingly, my channel-shaped bracket 50 is formed with hook portions 58 that are softer and more flexible than the remainder of the bracket 50. Since the web 52, the web extensions 54 and the leg portions 56 of the bracket 50 are extruded from relatively hard polyvinyl chloride, actually PVC having a D Shore value on the order of 90 as stated, the hook portions 58 are of a PVC having an A Shore value on the order of only 70. Such radically different ratio of softness to hardness permits each of the hook portions 58 to be progressively flexed so that the jamb liner 30 can be readily detached from its jamb 26 after the sash 14 has been removed.

Figure 5:
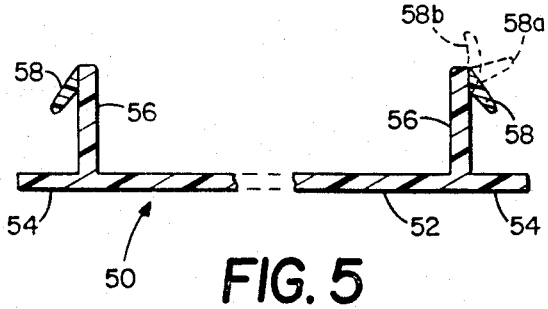
FIG. 5 is a sectional view taken in the direction of line 5—5 of FIG. 4, the two dotted positions representing the progressively flexed condition of the flexible hook portion that is experienced during the release of the jamb liner at the left side of the window of FIG. 1 after the lower sash has been removed.

In order to illustrate the degree of flexing that can take place, the hook portion 58 at the right in FIG. 5 has been shown in three positions. The solid line position, quite obviously, depicts the hook portion 58 in its normal position, this being the position in which it holds the jamb liner 30 in place by reason of its engagement with the ridge hook 46 on the jamb liner 30. The two dotted line positions, one being indicated by the reference numeral **58*a* and the other by the reference numeral 58*b*, show that the hook portion 58 can be flexed through approximately 150°. In this regard, the solid line position of the hook portion 58 at the right in FIG. 5 extends at an acute angle of approximately 30° with respect to the particular leg portion 56 to which it is attached, being capable of being flexed into what amounts to 180° or virtually straightline relationship with its leg portion 56, as illustrated by the dotted position thereof represented by the reference numeral 58*b***.

Figure 4:
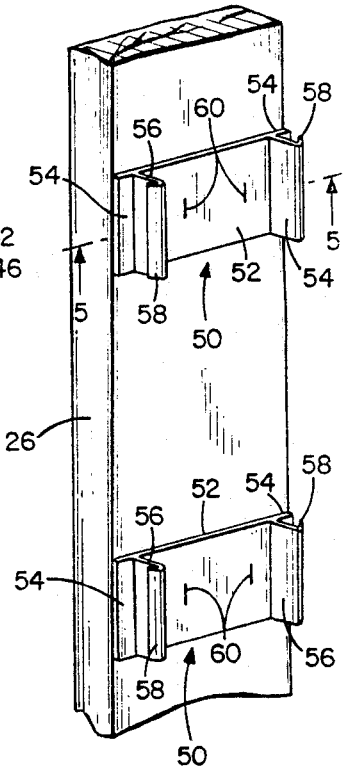
FIG. 4 is a perspective view of a portion of a wooden side jamb having two of my brackets attached thereto.

Whereas stamped metal brackets in the past have required holes so that the brackets can be either nailed or screwed into place on a wooden side jamb, such as that labeled 26, my invention, owing to the fact that the bracket 50 can be extruded so that it is quite thin, allows the web 52 to be stapled to the wooden jamb 26. The two staples for each of the two brackets 50 shown in FIG. 4 have been given the reference numeral 60. It will, of course, be appreciated that more than two brackets 50 may very well be employed, the number depending on the length of the particular jamb liner 30.

Although the principal purpose of the jamb liner 30 is to weatherproof the window unit 10, additional insulation is used in practice. Therefore, to complete the description of the window unit 10 when utilizing my brackets 50 it will be pointed out that a strip 64 of insulation, such as foamed polyurethane, is contained in the groove 38 formed between the channel sections 34 of the jamb liner 30. The strip 64 need not be adhesively anchored inasmuch as there is no relative movement of the strip 64 with respect to the jamb liner 30. Additionally, there is another strip 66 (thinner and wider than the strip 64) of insulating material that functions as a backer for the jamb liner 30. More specifically, the webs 36 of the two channel sections 34 confront the strip 66. It will be recognized by those familiar with this removable sash type of window unit 10 that the backing strip 66 can be compressed sufficiently so that the sash 14 can be tilted and removed from the track 32 of the jamb liner 30.

It is after the sash 14 has been taken out that the jamb liner 30 can be readily detached when employing the teachings of my invention. Obviously, the number of brackets 50 employed, as already explained, depends upon the size of sash 14 and the height of the frame 20 in which it is mounted. In any event, all that the worker need do is after removing the sash 14, grasp the jamb liner 30 near the bottom, doing so at the edge closer to him, and then working upwardly so that one edge of the jamb liner 30 is completely dislodged. He may wish to use a screw driver for prying out this edge, but no tool or implement is actually needed in order to flex each hook portion 58 through the various positions that it is flexed in order to release the jamb liner 30. The various positions, as earlier explained, have been pictorially illustrated in FIG. 5 and have been denoted by the reference numerals 58, **58*a* and 58*b***.

Figure 2:
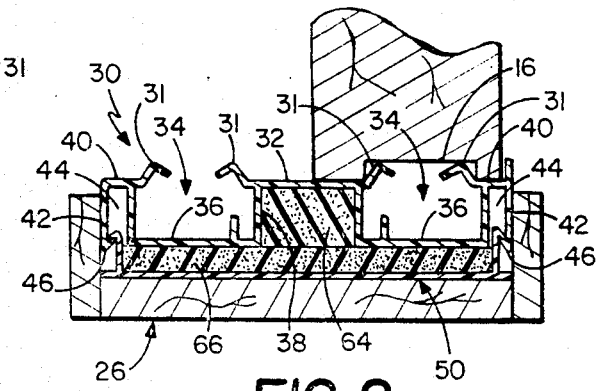
FIG. 2 is a horizontal sectional view taken in the direction of 2—2 of FIG. 1 depicting the jamb, the jamb liner, a portion of the lower sash, and one of my holding brackets used in conjunction therewith.

The flexibility of the hook portions 58 also facilitates the replacement of the jamb liner 30. In this respect, the hook portions 58 can be flexed inwardly from the approximately 30° relationship shown in FIG. 5 to a lesser or more acute angle with the consequence that the ridge hooks 46, which are relatively hard and rigid, act or cam against the hook portions 58 to provide the inward flexing, the hook portions 58 immediately returning to their unflexed condition once engaged with the ridge hooks 46. The engaged or holding relationship of the members 46 and 58 is depicted in FIG. 2. As should be apparent, the initial installation is also facilitated by reason of the softness and flexible character of the hook portions 58. Owing to the relative thinness of the web 52, coupled with the use of PVC, allow the various brackets 50 to be cut to a desired height, even on site, and then attached by means of the staples 60 rather than by the use of nails or screws that have heretofore been required to attach stamped metal brackets.

It has already been mentioned that the brackets 50 are fabricated from PVC and that the hook portions 58 are of a softer and more flexible PVC material than the remainder of the bracket 50. However, it can be borne in mind that the jamb liner 30 is usually fabricated from PVC having the same degree of hardness as the web 52, the web extensions 54 and the leg portions 56 of the bracket 50. Thus, the jamb liner 30 would have what amounts to a D90 Shore value, as do the web 52, the extensions 54 and the leg portions 56, this being in direct contrast to the relatively soft character of the hook portions 58 which have a durometer Shore value of only approximately A70.

I claim:

1. A bracket for use with a jamb liner, the bracket comprising a plastic channel-shaped member including a web and laterally spaced leg portions projecting in one direction from said web, and a single hook portion connected to the free edge of each of said leg portions and normally extending at an acute angle that is generally opposite to said one direction in which its associated leg portion extends, said hook portions being more flexible than said leg portions.

2. The bracket of claim 1 in which said hook portions have the capability of flexing in said one direction and into substantially a straight line relationship with said leg portions.

3. The bracket of claim 1 in which the flexibility of said hook portions is derived by reason of said hook portions having a lesser degree of hardness than said leg portions.

4. The bracket of claim 1 in which said hook portions have a lower durometer value than said leg portions so as to impart greater flexibility to said hook portions than that possessed by said leg portions.

5. The bracket of claim 4 in which the plastic material is polyvinyl chloride.

6. The bracket of claim 5 in which said leg portions have a durometer value on the order of Shore D90 and said hook portions have a durometer value on the order of Shore A70.

7. In combination, a jamb liner of plastic material including laterally spaced and generally parallel side walls, each side wall having a free edge and a relatively stiff ridge hook extending therealong and integral therewith, each of said ridge hooks forming an acute angle with the plane of the side wall with which it is integral and a channel-shaped plastic bracket including a pair of leg portions having free edges and a softer and more flexible hook portion integral with each of said leg portions at the free edge thereof and each of said flexible hook portions normally extending at an acute angle and in a generally opposite direction with respect to relatively stiff ridge hooks, said hook portions releasably engaging said ridge hooks.

8. The combination of claim 7 in which the plastic material for said jamb liner and said bracket is polyvinyl chloride.

9. The combination of claim 8 in which said hook portions have a lower durometer value than said leg portions so as to render said hook portions softer and more flexible than said leg portions.

10. The combination of claim 9 in which the durometer value of said leg portions is on the order of Shore D90 and the durometer value of said hook portions is on the order of Shore A70.

11. The combination of claim 10 in which the durometer value of said jamb liner is also on the order of Shore D90.

12. The combination of claim 7 in which said flexible hook portions extend only along a relatively small segment of said ridge hooks.

13. The combination of claim 12 including a second channel-shaped bracket spaced from said first channel-shaped bracket, said second bracket also including a pair of leg portions having free edges and a softer and more flexible hook portion integral with each of said leg portions at the free edge thereof and each of said flexible hook portions normally extending at an acute angle and in a generally opposite direction with respect to said relatively stiff ridge hooks, said last-mentioned hook portions releasably engaging said ridge hooks at locations spaced from the hook portions of said first channel-shaped bracket.

14. A plastic bracket for use with a jamb liner, the bracket comprising a web portion, laterally spaced leg portions projecting generally at right angles and in one direction from said web portion, and additional portions extending in generally opposite directions from said web portions, said additional portions forming a right angle with said leg portions, the bracket further including single hook portions at the free edges of said leg portions, said flexible hook portions normally angling at an acute angle toward said additional portions and being more flexible than said leg portions so that said flexible hook portions can flex into generally obtuse angles with respect to said leg portions.

* * * * *